United States Patent [19]

Huang

[11] Patent Number: 4,688,402

[45] Date of Patent: Aug. 25, 1987

[54] KNITTING MACHINE TRANSMISSION MECHANISM ASSEMBLY

[76] Inventor: Kuo-Ching Huang, No. 43, Pao An Tsun, Jen Te Hsiang, Tainan Hsien, Taiwan

[21] Appl. No.: 902,203

[22] Filed: Aug. 29, 1986

[51] Int. Cl.[4] ..... D04B 15/88

[52] U.S. Cl. ..... 66/149 R; 192/71; 192/93 C

[58] Field of Search ..... 66/149 R, 150, 152; 192/71, 93 C

[56] References Cited

U.S. PATENT DOCUMENTS 4,036,266 7/1977 Gsell et al. ..... 66/149 RX

*Primary Examiner*—Wm. Carter Reynolds

*Attorney, Agent, or Firm*—Poms, Smith, Lande & Rose

[57] ABSTRACT

An improved transmission mechanism assembly for knitting machines having a shaft structure and gear combination mounted at the lower end of the transmission mechanism. The transmission mechanism incorporates an electronically controlled magnetic relay. When the base and mouth of knitted bags require high density knitting in order to form reinforced belts, cessation of fabric takeup during knitting processes can be performed on the knitted bag in order to form reinforced belts. As a result, rigid PP or PE knitted bags can be easily and conveniently made.

1 Claim, 7 Drawing Figures

KNITTING MACHINE TRANSMISSION MECHANISM ASSEMBLY

BACKGROUND OF THE INVENTION

As is well known, bags for the containing of fertilizers and livestock feeding materials are usually made from knitted PE or PP plastic yarn. In the knitting of plastic yarn, however, automatic tubular knitting machines are preferred over other types of knitting machines because of their high knitting rate. FIG. 5 is a conventional tubular knitting machine, which comprises a picking bowl carrying the pin and the wrap on the picking passage to form knitted fabric at the rotating element (a), and then, the cloth passes through the center of the upper and lower shaft. The rotating of the shafts (b and c) was achieved by the transmission mechanism (d) and caused the shaft (e) to rotate. At the top of said rotating shaft (e), a bevel gear (e1) is provided which engages with a corresponding bevel gear (f). Bevel gear (f), in turn, rotates the upper and lower shafts (b and c) after which the knitted cloth is rolled up on the rolling element (g). However, the speed of the press rollers (b and c) affects the density of knitting of the knitted belt. If the press rollers rotate too slowly, then the formed knitted belt has a high knitting density. Generally, in the interest of practicality and low manufacturing costs, the speed of the rotating shaft (b and c) must be kept constant, which means that the plastic yarn is first knitted and made into a bag by sewing across the knitted product to form a bag in a separate machine. However, the mouth and the base of the bags must be repeatedly knitted in order to better reinforce them, which means that additional procedures are required before such bags are completed. Hence, the traditional means of knitting these bags are very inconvenient and the manufacture thereof is uneconomical.

SUMMARY OF THE INVENTION

An object of the invention is to provide an improved transmission mechanism structure for a tubular knitting machine, in which the transmission mechanism is incorporated in the machine such that reinforcing belts can be introduced to the knitted bags.

A further objective of the invention is to provide an improved transmission mechanism structure for a tubular knitting machine having performance characteristics superior to any heretofore available.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 3-1 and FIG. 3-2 are schematic views of the gear system of the present invention;

FIG. 4-1 is a side view and FIG. 4-2 is a plan view of the gear transmission system of the present invention;

DETAILED DESCRIPTION OF THE PRESENT INVENTION

Figure 1:
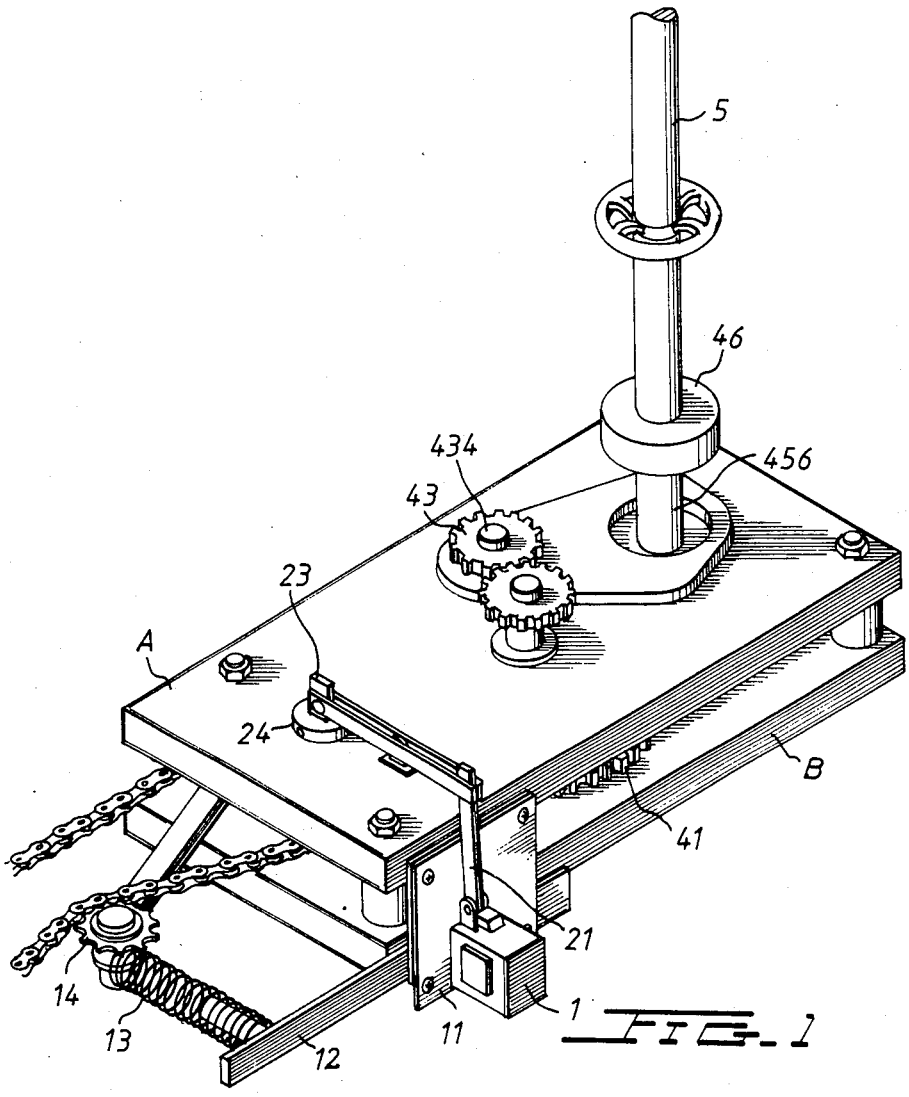
FIG. 1 is a perspective view of the present invention.

In FIG. 1, the knitting machine transmission mechanism assembly of the present invention is shown. The invention comprises two rectangular plates (A and B) and connecting element (21) and several sets of gears which are situated in between the plates (A and B) so as to form a transmission mechanism. The transmission mechanism incorporates a magnetic relay (1) to operate the connecting rod (21), which, in turn, transmits motion to the gear system. The gear system then rotates a shaft (5), which in turn rotates the bevel gear (f) and enable the rolling means (g) to function and form tubular fabric. The magnetic relay (1) controls the gear system and if the gear system is disengaged, the rotating shaft (5) stops and the base and mouth of the bags can be repeatedly knitted so as to make a reinforcing belt. For fertilizers, the length of bags is usually 100 cm and the width of the reinforcing belt is 2.5 cm. An electronic controlling mechanism controls the transmission element in knitting the fabric for 100 cm, and the gear system of the transmission mechanism is disengaged which causes the rotating shaft to stop, thus stopping the takeup process. The electronic controlling element sets the transmission mechanism such that the length of the fabric is 102.5 cm and the knitting process for the reinforcing belt starts.

Figure 2:
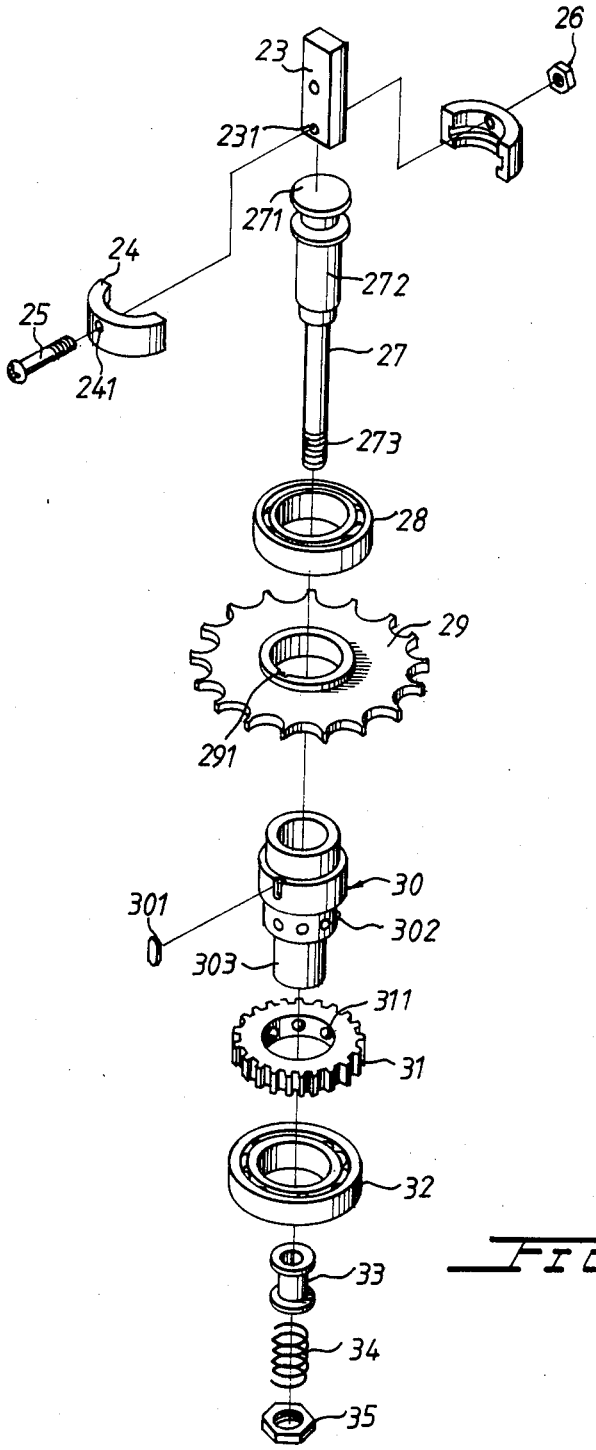
FIG. 2 is an exploded view of the present invention.

Referring to FIG. 1 and FIG. 2, it can be seen that the vertical connecting rod (21) is joined to the bottom of the magnetic relay (1) and also connected by means of a screw, to a horizontal connecting rod (22), the other end of which is joined to a supporting rod (23). Referring to FIG. 2, it can be seen that on the supporting rod (23), an aperture (231) is provided and is aligned with hole (241) of the semi-circular shaped fastening element (24), and then, by means of a screw (25) and a nut (26), the supporting rod (23) and the fastening element (24) is firmly secured. A groove (242) is provided on the internal surface of fastening element (24) which can be engaged with a plate (271) of a central hollow rod (27). The central rod (27) is a long hollow tube.

Figures 1, 3:
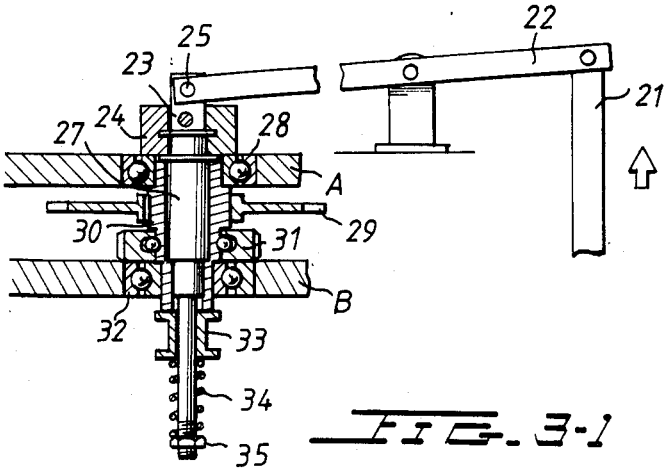
Figures 2, 3:
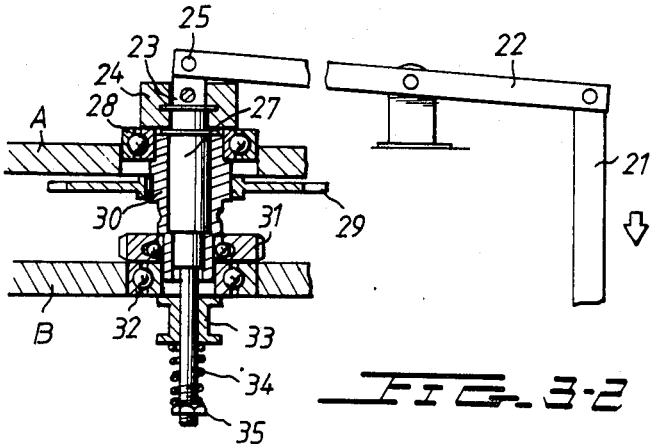

Referring to FIGS. 2, 3-1, and 3-2, it can be seen that the center region of the central rod (27) is enclosed by a straight rod (272) while screw threads (273) are set at the bottom of central rod (27). The central rod (27) is fitted with upper bearings (28), an upper sprocket (29), a housing (30), a lower gear (31), a lower bearing (32), a short tubing (33) and a spring (34). These parts are securely tightly together with a nut (35). The upper and lower bearings (28 and 32) are respectively located at the circular slot of the rectangular plate (A and B), along the inner surface of the upper sprocket (29), is provided with a vertical slot (291) and when the upper sprocket (29) is fitted into the housing (30), a block (301) can be fitted, such that the upper gear (29) can be fitted to the housing (30), the central region of the circumference of the housing (30) is provided with several holes (302) which engage with the ball bearings (311) of the lower gear (31). However, when the housing (30) is moved upward, the ball bearing (311) of the lower gear (31) will disengage with the hole (302) of the housing (30) but it is at the straight rod (303) of the housing (30) (as shown in FIG. 3-2).

Figures 1, 4:
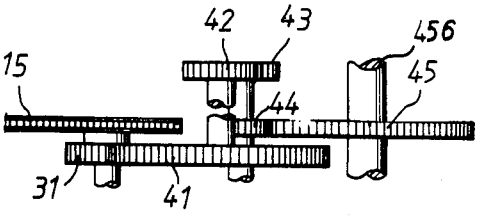
Figures 2, 4:
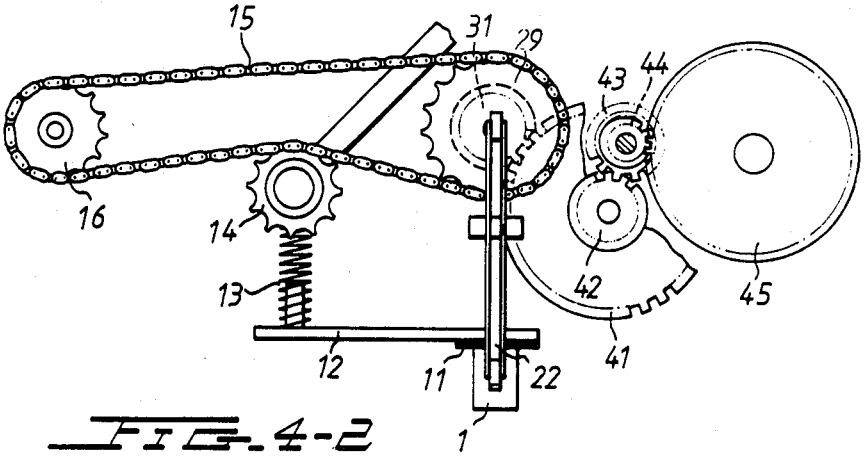
Figure 5:
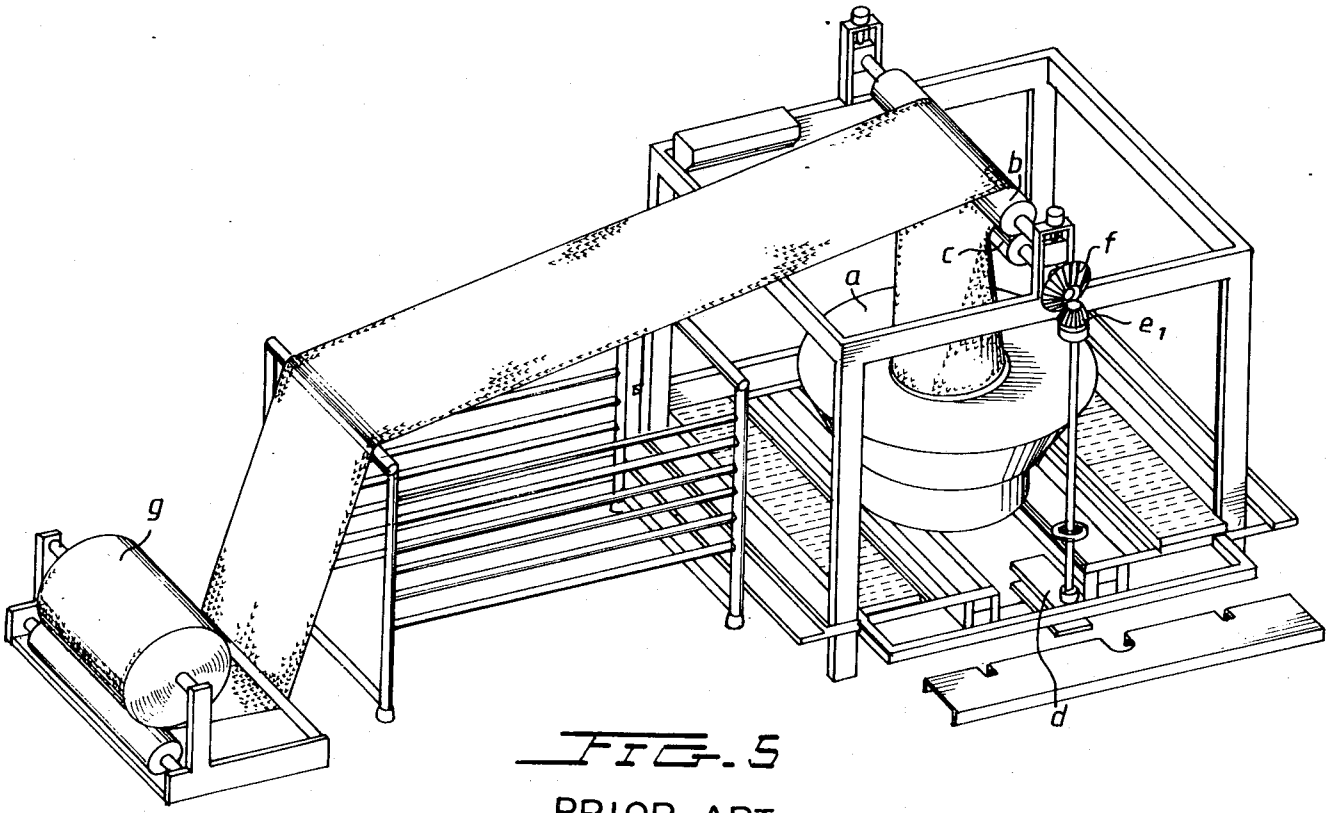
FIG. 5 PRIOR ART
FIG. 5 is a prior art tubular knitting machine.

Referring to FIGS. 1, 4-1, and 4-2, the magnetic relay (1), is secured to a board (11). One face of said board (11) is provided with a straight rod (12). The rod (12) is provided with a spring (13) at one end. The spring (13) is connected to the lower portion of a gear (14). Gear (16) is a driving gear which drives the upper sprocket (29) by means of chain (15). Thus, the upper sprocket (29) is indirectly driven by the driving gear (16) and gear (14) is meant for the tauting of chain (15). The upper sprocket (29) simultaneously drives the lower gear (31), which is coaxial to the upper sprocket (29). The lower gear (31) is engaged with a first gear (41), which is coaxial with a second gear (42), which is engaged with a third gear (43). Similarly, the third gear (43) is coaxial with a fourth gear (44) on shaft (434), and the fourth gear (44) is engaged with a fifth gear (45) of central rod (456), such that the top of said rod (456) is connected with the rotating rod (5) by means of a connector (46) (as shown in FIG. 1). Therefore, when the driving gear (16) is rotated, the transmission system is driven and, in turn, the bevel gear (f) is rotated, thus achieving the desired takeup process (refer to FIG. 3-1).

For reinforcement purposes, it is necessary to stop the rotating shaft (5) in order to allow the repetition of knitting at the mouth and at the base of the bag. A magnetic relay (1) controls the vertical rod (21) and allows it to move downward, and causes the end of the horizontal rod (22) connecting to the vertical rod (21) to be urged downwards and the other end of the horizontal rod (22) connecting to the supporting rod (23) to be urged upwards on the opposite end thereof. Referring to FIGS. 2 and 3-2, it can be seen that the horizontal connecting rod (22) lifts up the supporting rod (23) and the central rod (27) at the same time. This causes the ball bearing (311) of the lower gear (31) to disengage from the hole (302). As a result, the lower gear (31) and the housing (30) are disengaged from each other. When the driving sprocket (14) and the upper sprocket (29) are disengaged, the gear (31) will not be rotated. As a result, the rest of the gears (41, 42, 43, 44 and 45) will not be rotated, which also means that the rotating rod (5) will not be rotated. Thus, the knitting process will be repeated at the mouth and base of the bag so as to form a reinforcing belt. If the length of the reinforcing belt exceeds the pre-set value which is controlled by the electronic control mechanism, then the magnetic relay (1) drives up the connectng rod 21 as shown in FIG. 3-1.

I claim:

1. An improved transmission mechanism assembly for tubular knitting machines comprising an upper and a lower plate, a vertical connecting rod and a gear system with a magnetic relay together with electronic control system; said improved transmission mechanism assembly being further characterized in that:

said vertical connecting rod is connected to said magnetic relay and also connected to a horizontal rod by means of a screw, one end of said horizontal rod is connected to a supporting rod, a hole is provided at the bottom of said supporting rod which can be aligned with the hole of a fastening block and secured with a nut, a slot is provided along the inner surface of said fastening block such that said slot engages with the plate of a central rod, said central rod is a long hollow tube which is threaded on one end, and said central rod can be fitted respectively with: upper ball bearings, an upper sprocket, a housing, a lower gear, lower ball bearings, a spring and nut which screws on at the bottom thereof; said upper and lower bearings are respectively located on a circular slot of the upper and lower plate, a vertical slot is provided along the inner surface of the upper sprocket to be fitted with a block so as to fix the upper sprocket on said housing, several rounded holes are provided at the center of said housing, said rounded holes are engageable with the ball bearings of said lower gear and when said housing is lifted the ball bearings are disengaged from the rounded holes;

said magnetic relay is secured to a fastening board, the front end of said fastening board is fitted with a straight rod, a spring is secured to said straight rod, said spring is connected to a gear which tauts a chain, a driving gear drives said upper sprocket by means of said chain, said lower gear which is coxial with and said upper sprocket, said lower gear is engaged with a first gear between the upper and lower plate, said first gear is coaxial with a second gear above the upper plate, said second gear is engaged with a third gear which is coaxial with a fourth gear, said fourth gear engages with a fifth gear of a second central rod and a top of said second central rod is connected with a rotating shaft that effects knit fabric takeup.

* * * * *